US005645510A

United States Patent [19]

Wilkinson

[11] Patent Number: 5,645,510

[45] Date of Patent: Jul. 8, 1997

[54] COMBINATION EXERCISE DEVICE

[76] Inventor: William T. Wilkinson, Sevenside Farm, 300 Kyle Rd., Crownsville, Md. 21032-0572

[21] Appl. No.: 251,105

[22] Filed: May 31, 1994

Related U.S. Application Data

[63] Continuation-in-part of Ser. No. 151,957, Nov. 15, 1993, Pat. No. 5,533,948, which is a continuation-in-part of Ser. No. 986,487, Dec. 7, 1992, abandoned, and a continuation-in-part of Ser. No. 56,930, May 5, 1993, Pat. No. 5,284,461, and a continuation-in-part of Ser. No. 55,750, May 3, 1993, abandoned, which is a continuation-in-part of Ser. No. 945,373, Sep. 16, 1992, Pat. No. 5,207,622.

[51] Int. Cl.[6] ..... A63B 21/00

[52] U.S. Cl. ..... 482/27; 482/51; 482/52; 482/74

[58] Field of Search ..... 482/27, 28, 29, 482/51, 52, 74, 908; 472/90

[56] References Cited

U.S. PATENT DOCUMENTS

| | | | |
|---|---|---|---|
| 2,324,970 | 7/1943 | Wooley | 482/29 |
| 3,310,305 | 3/1967 | Howe | 482/29 |
| 3,837,643 | 9/1974 | Lee | 482/29 |
| 4,630,816 | 12/1986 | Hill | 482/51 |
| 5,282,776 | 2/1994 | Dalebout | 482/52 |
| 5,425,691 | 6/1995 | Van Der Hoever | 482/52 |
| 5,472,390 | 12/1995 | Faye | 482/52 |

*Primary Examiner*—Jerome Donnelly
*Attorney, Agent, or Firm*—Connolly & Hutz

[57] ABSTRACT

A combination exercise device includes a trampoline which has a peripheral frame and a resiliently mounted spring member secured to the frame with an upper surface upon which the user may jump. Feet are mounted to the frame for elevating the spring member. The exercise device also includes a step which has a horizontal rigid platform upon which the user may repeatedly step on and off in an aerobic exercise. The trampoline is selectively mounted with respect to the step so that the upper surface of the spring member of the trampoline is selectively disposed above the platform at a sufficient distance to permit the trampoline to be used while mounted over the spring member. In other stages of use the trampoline is removed from the step so that the step may be used in an exercise mode. Alternatively, the trampoline may be of a sufficiently small size that the step and trampoline could be permanently mounted together and both types of exercises could then be selectively performed.

10 Claims, 2 Drawing Sheets

COMBINATION EXERCISE DEVICE

CROSS-REFERENCE TO RELATED APPLICATIONS

This application is a continuation-in-part of U.S. patent application Ser. No. 151,957 filed Nov. 15, 1993 now U.S. Pat. No. 5,533,948; which in turn is a continuation-in-part of U.S. patent application Ser. No. 07/986,487 now abandoned, filed Dec. 7, 1992; U.S. patent application Ser. No. 08/55,750 now abandoned filed May 3, 1993; and U.S. patent application Ser. No. 08/56,930 now U.S. Pat. No. 5,284,461 filed May 5, 1993; U.S. patent application Ser. No. 08/55,750 now abandoned is a continuation-in-part of U.S. Pat. No. 5,207,622, U.S. patent application Ser. No. 08/945,373 filed Sep. 16, 1992.

BACKGROUND OF THE INVENTION

Two popular forms of exercise are aerobic stepping and trampoline. Heretofore, it has been necessary for a user to purchase two separate units to do these exercises. This is not only expensive but the two units take up considerable space. There is a need for a device that combines the two forms of exercise into a single unit. This would reduce cost and minimize storage space.

SUMMARY OF THE INVENTION

An object of this invention is to provide a combination exercise device which incorporates the trampoline and an aerobic step in the same unit.

A further object of this invention is to provide such an exercise device which may include further forms of exercise such as exercise cords and upper body exercise poles.

In accordance with this invention a combination exercise device comprises a trampoline and an aerobic step. The trampoline has a peripheral frame with a resiliently mounted spring member secured to the frame. The spring member has an upper surface upon which the user may jump. Feet are mounted to the frame for elevating the spring member. The step has a horizontal rigid platform which may be used by the user for performing the aerobic stepping exercise. In one practice of the invention the trampoline is mounted over the step with the spring member spaced a sufficient distance above the platform to permit normal trampoline usage. The trampoline may be detachably mounted by a detachable connection or by straddling over the step. During periods of non-use the trampoline may be stored below the step. Alternatively, the trampoline may be a mini-trampoline which could be permanently mounted to the step so that at least a portion of the step platform is always exposed to provide the user with the ability to perform either or both of the trampoline or aerobic step exercises.

Variations of the invention include mounting a second step above the trampoline. Variations also include providing elastic exercise cords and resistance poles.

THE DRAWINGS

DETAILED DESCRIPTION

Figure 2:
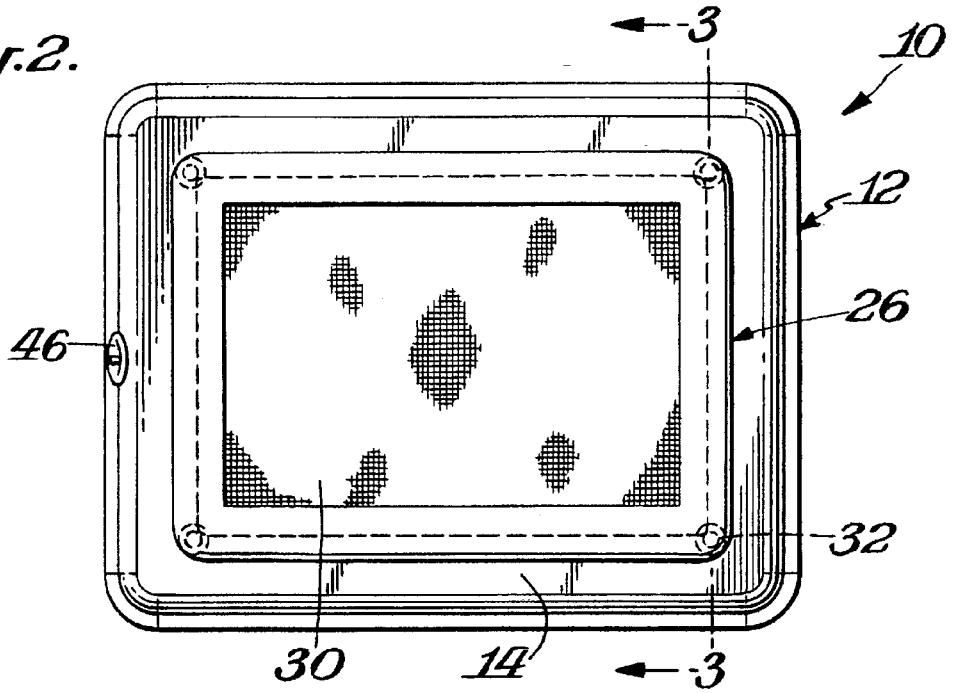
FIG. 2 is a top plan view of the exercise device shown in FIG. 1, but omitting the second step.

The present invention is directed primarily to combining a trampoline with an aerobic step. Parent Application Ser. No. 151,957 discloses one manner of practicing the invention wherein primary emphasis is made with regard to mounting the step over the trampoline. The details of the parent application as well as the parent applications and patent of Ser. No. 151,957 are incorporated herein by reference thereto. The present invention is directed to variations of the techniques described in parent application Ser. No. 151,957.

The present invention takes into account that there are three basic ways to combine a trampoline and an aerobic step. One is for the trampoline to fit on top of the aerobic step. Preferably the trampoline could be removable by any means such as sliding off, lifting off, snapping off, etc. The trampoline could also be dimensioned to simply straddle over the step. It is preferred that during non-use of the trampoline the trampoline would be stored underneath the step although the trampoline could be stored free standing.

A second basic way of combining a trampoline and step is for the trampoline to be built into the step frame. The stepping member or platform would removably fit on top of the trampoline when it is desired to perform an aerobic step exercise. When, however, it is desired to perform a trampoline exercise the platform would be removed and could be stored underneath the frame. Such removal or detachable mounting could be accomplished in any suitable manner, such as sliding off, lifting off, snapping off, post and hole, track in groove, etc.

A third way for combining a trampoline and an aerobic step is to provide two separate units, but to dimension the units so that one can store underneath the other. Preferably, the trampoline would be a mini-trampoline which could store underneath the step.

It is preferable in the practice of the invention to provide selective height adjustment and more particularly by adjusting the height of the step frame rather than the step platform with respect to the frame.

The invention could be practiced by forming the step and trampoline of any shape, such as a circle or oval, although a square or rectangle is preferred.

The combined trampoline/aerobic step unit could be enhanced by incorporating other exercise devices such as the resistance disk described in the parent application or elastic exercise cords or bands or upper body exercise poles with or without resistance.

Reference is had to the various above noted applications and patent and to my other patents relating to aerobic steps for various manners of achieving height adjustability and detachable mounting means.

FIGS. 1–4 illustrate one embodiment of the invention wherein the combination exercise device 10 includes an aerobic step 12 which comprises a horizontal rigid platform 14 upon which the user may repeatedly step on and off in an aerobic exercise. Platform 14 includes a depending apron 16 with a plurality of legs 18 adjustably mounted at each corner of the base member which comprises the platform and apron. In the illustrated embodiment legs 18 fit into passages 20. Each leg has a spring pin 22 for fitting in a selective opening 24 in the passage 20. It is to be understood, however, that the illustrated manner of height adjustability is merely for exemplary purposes and any other suitable height adjustability could be used such as disclosed in the parent applications and patent.

Device 10 also includes a trampoline 26 which has a peripheral frame 28. A spring member 30 is resiliently secured to the frame 28 in any suitable known manner so as to provide a surface upon which the user may jump in performing a trampoline exercise. Frame 28 includes feet or downward extensions 32 to provide a manner of mounting the trampoline 26 to the step 12 while still maintaining a sufficient space between platform 14 and spring member 30 so that when the trampoline is mounted to and above the step the trampoline may still properly function.

Any suitable means may be used for detachably mounting the trampoline to the frame. In the illustrated embodiment each foot 32 terminates in a recessed extension or pin 34 thus leaving a shoulder 36 where the extension is connected to the foot. A corresponding opening 38 is provided in platform 14 at each location of a foot 32 so that the extensions 34 may fit into the openings 38 with the shoulders 36 resting on the upper surface of platform 14. It is again to be understood that the illustrated manner of detachably mounting trampoline 26 to step 12 is for exemplary purposes. The invention may be practiced with other manners of detachable mounting such as disclosed in the parent applications and patent with regard to detachably mounting one unit to another.

Figure 1:
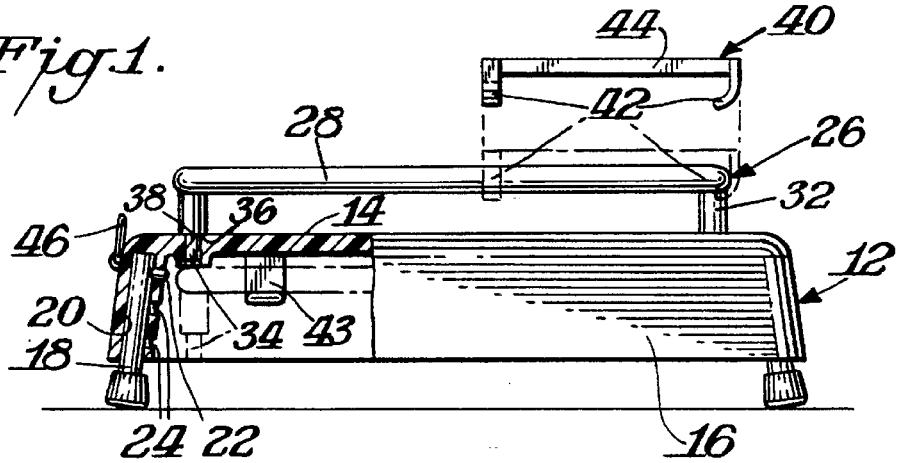
FIG. 1 is a side elevational view partly broken away and in section of a combination exercise device in accordance with one embodiment of this invention.
Figure 3:
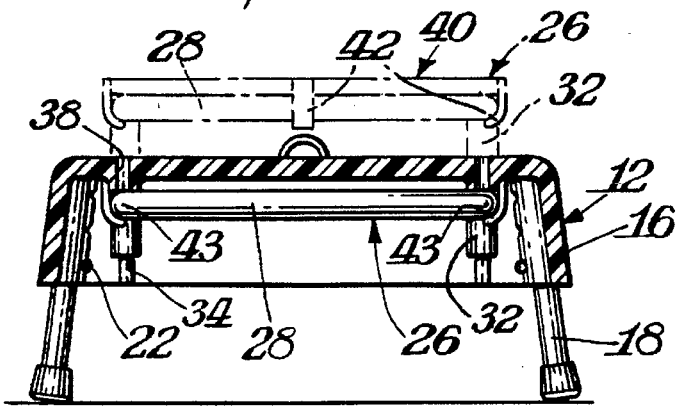
FIG. 3 is a cross-sectional view taken through FIG. 2 along the line 3—3.
Figure 4:
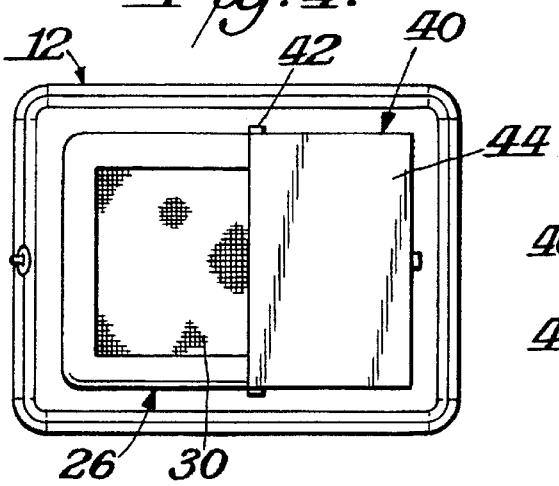
FIG. 4 is a top plan view of the exercise device shown in FIG. 1 including the second step.

FIGS. 1, 3 and 4 illustrate a variation of the invention wherein a second aerobic step 40 is detachably secured to trampoline frame 28. In the illustrated embodiment the securement is accomplished by retainer clips 42 in the manner described in parent application Ser. No. 151,957. When step 40 is thus mounted to trampoline frame 28 it is possible to use the platform 44 of step 40 for an aerobic exercise and as part of an exercise program to use a portion of the exposed trampoline for a trampoline exercise. Where the trampoline is dimensioned sufficiently smaller than step 12, it is possible to also have an exposed portion of platform 14 so that in effect a three level exercise device thereby results. The lower level would be the exposed portion of step platform 14, the intermediate level would be the exposed portion of spring member 30 and the upper level would be platform 44.

Trampoline 26 is dimensioned so that periods during nonuse it could slide underneath apron 16 of step 12. Similarly, upper step 40 could also slide underneath frame 28 of trampoline 26 or under a further portion of apron 16. Thus, the portion of device 10 which are not being used could be conveniently stored. If desired, spring clips 43 could be secured to step 12 for positively mounting trampoline 26 beneath step 12 during non-use as shown in phantom in FIG. 1 and in solid in FIG. 3.

A variation of device 10 would be to form the trampoline spring member as part of the stepper frame where platform 14 is illustrated. Platform 14 could then simply be a panel-like member which would be detachably mounted over the trampoline spring member when it is desired to use the device as a stepper.

A further variation of the invention is to permanently mount the trampoline and stepper together. In that variation, however, it would be necessary to dimension the trampoline so that a portion of the platform is always exposed and is of sufficient size to permit the platform to be used as a stepper.

A yet further alternative for permanently mounting the trampoline to the stepper would be to provide the mounting as a hinged connection which would permit the trampoline to be of larger size even comparable to the size of platform 14. When it is desired to use the stepper the trampoline frame would be pivoted away from platform 14 to expose platform 14. Conversely when it is desired to use the trampoline the frame 28 would be pivoted directly over platform 14 so that the spring member 30 is in a horizontal orientation for use of the trampoline.

Figure 7:
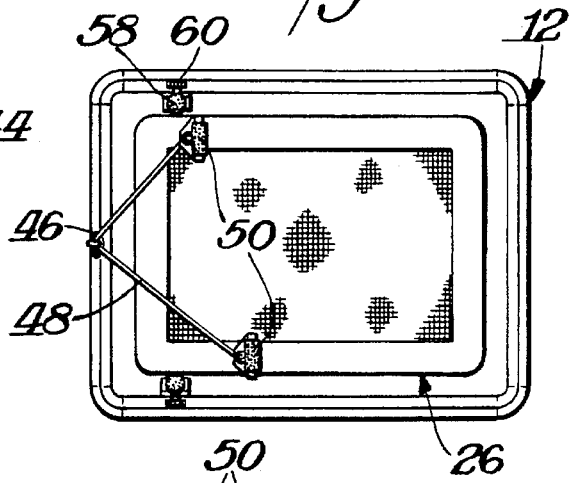
FIG. 7 is a top plan view of yet another form of exercise device in accordance with this invention.
Figure 5:
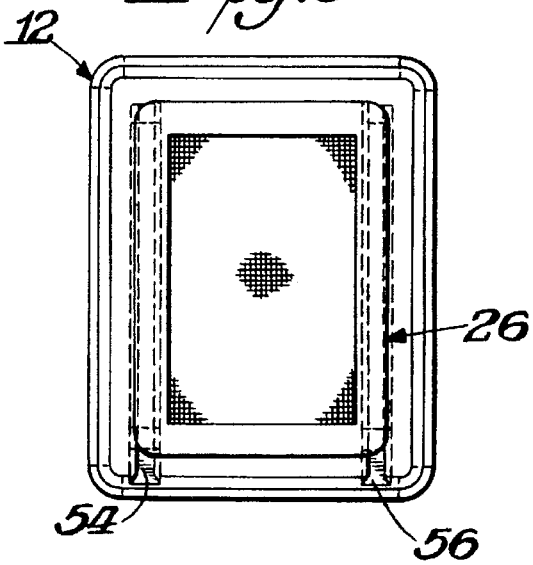
FIG. 5 is a top plan view of a modified exercise device in accordance with this invention.
Figure 8:
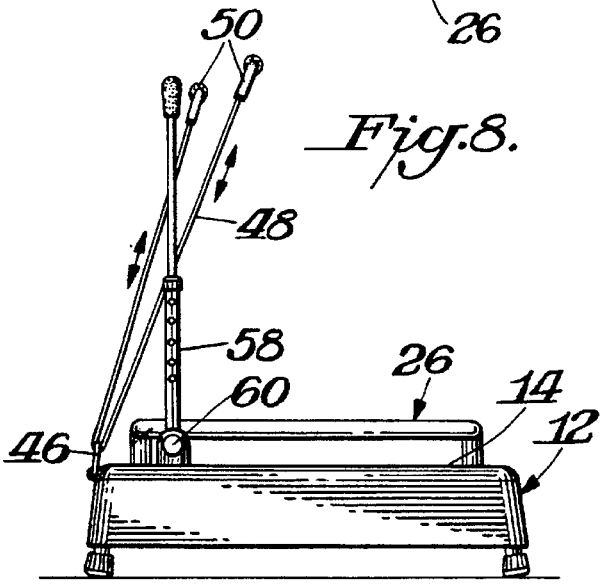
FIG. 8 is a side elevational view of the exercise device shown in FIG. 7.
Figure 6:
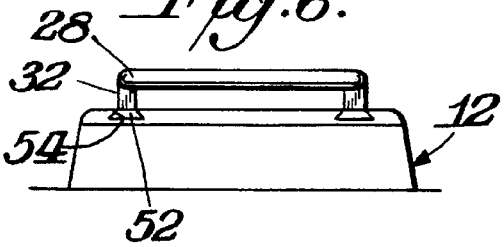
FIG. 6 is an end elevational view of the device shown in FIG. 5.

FIGS. 1 and 2 also illustrate the provision of a ring member 46 which could be used for the attachment of exercise cords as illsutrated in FIGS. 7 and 8 where the exercise cords 48 extend through the ring 46 and terminate in handle portions 50. Exercise cords are preferably resilient members to provide resistance to a pulling by the user during the trampoline and/or stepper exercise. FIGS. 5–6 illustrate a variation in the manner of detachably mounting trampoline 26 to step 12. As shown therein, the feet 32 of frame 28 terminate in a dove tail structure 52 which mates with a correspondingly shaped channel 54 in platform 14. A spring pin may be provided in channel 54 for mounting in a corresponding opening in dove tail 52 when the frame 28 is properly positioned to lock the frame in place. Alternatively, the spring pin could be in the dove tail and the opening could be in the channel.

FIG. 5 illustrates the dove tail structure 52 to have an outward flare 56 which is of larger dimension than channel 54 to limit the extent of sliding movement of the dove tails 52 in channels 54.

FIGS. 7 and 8 illustrate the possibility of including ancillary exercise devices in addition to the trampoline and stepper. As previously noted these devices may include exercise cords 48. Other possible devices include resistance poles 58 pivotally mounted at 60 to the main support such as on platform 14. Details of the pivotal mounting and adjustable resistance as well as the extensibility of the poles are found in the various parent applications. It is to be understood that other devices, such as a twister could also be included in the combination exercise device in accordance with this invention.

What is claimed:

1. A combination exercise device comprising a step, said step having a horizontal rigid platform upon which a user may repeatedly step on and off in an aerobic exercise, a trampoline, said trampoline comprising a peripheral frame, a resiliently mounted spring member secured to said frame and having an upper surface upon which the user may jump, downwardly extending feet mounted to said frame for elevating said spring member, and mounting means mounting said trampoline directly to and directly above said step.

2. The device of claim 1 wherein said trampoline is detachably mounted to said step.

3. The device of claim 2 wherein said step includes feet elevating said platform, and said trampoline having a height and width dimensioned sufficiently small to store said trampoline beneath said platform during periods of nonuse.

4. The device of claim 3 including means for adjusting the height of said device.

5. The device of claim 1 including elastic exercise cords mounted to said step.

6. The device of claim 1 including pivotally mounted resistance poles mounted to said step.

7. A combination exercise device comprising a step, said step having a horizontal rigid platform upon which a user may repeatedly step on and off in an aerobic exercise, a trampoline, said trampoline comprising a peripheral frame, a resiliently mounted spring member secured to said frame and having an upper surface upon which the user may jump, downwardly extending feet mounted to said frame for elevating said spring member, mounting means for mounting said trampoline above said step and an auxiliary step mounted to said trampoline directly to and above said spring member.

8. The device of claim 7 wherein said auxiliary step is of lesser dimension than said spring member, and a portion of said spring member being exposed when said auxiliary step is mounted to said trampoline to permit said exposed portion of said spring member to be used during a trampoline exercise while said auxiliary step is mounted to said trampoline.

9. The device of claim 8 wherein said spring member is of sufficiently lesser dimension than said platform to expose a portion of said platform when said trampoline is mounted above said step to permit the selective use of said spring member and said platform for exercise purposes.

10. The device of claim 1 wherein said spring member has an upper surface of lesser area than the area of the upper surface of said platform to expose a portion of said upper surface of said platform when said trampoline is mounted above said step to permit the selective use of said spring member and said platform for exercise purposes.

* * * * *